US005980582A

United States Patent [19]

Gehrlein et al.

[11] Patent Number: 5,980,582

[45] Date of Patent: Nov. 9, 1999

[54] METHOD AND APPARATUS FOR CONTINUOUSLY TREATING A WEB OF FABRIC

[75] Inventors: Heiner Gehrlein; Lothar Wefers, both of Krefeld; Wolfgang Tschirner, Tönisvorst, all of Germany

[73] Assignee: Kleinewefers Textilmaschinen GmbH, Krefeld, Germany

[21] Appl. No.: 08/970,923

[22] Filed: Nov. 14, 1997

[51] Int. Cl.[6] ..... D06B 3/10

[52] U.S. Cl. ..... 8/149.1; 8/151; 68/17 R; 68/205 R; 68/202

[58] Field of Search ..... 68/205 R, 202, 68/17 R; 8/149.1, 151, 111

[56] References Cited

U.S. PATENT DOCUMENTS

| | | | |
|---|---|---|---|
| 3,960,485 | 6/1976 | Fantl et al. . | |
| 3,998,740 | 12/1976 | Bost et al. . | |
| 4,060,386 | 11/1977 | Katz . | |
| 4,106,900 | 8/1978 | Perkins . | |
| 4,192,649 | 3/1980 | Kato et al. . | |
| 4,244,200 | 1/1981 | Sando et al. | 68/202 |
| 4,289,577 | 9/1981 | Mabuchi et al. . | |
| 4,333,190 | 6/1982 | Ruettiger et al. . | |
| 4,557,006 | 12/1985 | Sando et al. . | |
| 5,376,143 | 12/1994 | Wasinger et al. . | |

FOREIGN PATENT DOCUMENTS

| | | |
|---|---|---|
| 0 352 591 | 1/1990 | European Pat. Off. . |
| 0 558 892 | 9/1996 | European Pat. Off. . |
| 1 460 287 | 12/1968 | Germany . |
| 16 35 101 | 4/1971 | Germany . |
| 43 03 920 | 11/1994 | Germany . |
| 43 31 275 | 3/1995 | Germany . |
| 195 36 355 | 4/1997 | Germany . |

*Primary Examiner*—Frankie L. Stinson
*Attorney, Agent, or Firm*—Darby & Darby

[57] ABSTRACT

A method and apparatus for continuously treating a web of fabric in a first treatment section and a second treatment section through which the web of fabric passes. The first treatment section includes a desizing station. The desizing station includes an application stage having a plurality of spray nozzles, a dwell stage, a mechanical liquid removal device and a wash stage. A first return conduit fluidly connects the wash stage to the application stage. The method includes applying a size containing size carrier on the web of fabric to desize the web of fabric. The size containing size carrier is removed from the web of fabric after the size carrier has taken effect upon the web of fabric. At least a portion of the removed size containing size carrier is added to the size carrier solution before the solution is applied to an upstream portion of the web of fabric.

23 Claims, 3 Drawing Sheets

METHOD AND APPARATUS FOR CONTINUOUSLY TREATING A WEB OF FABRIC

BACKGROUND OF THE INVENTION

1. Field of the Invention

The present invention relates to a method and apparatus for continuously treating a web of fabric.

2. Discussion of the Related Art

In the production of continuous webs of fabrics it is generally necessary, before weaving, to apply size to the yarn. After weaving, the size must be removed from the fabric. As disclosed in, for example, European reference No. EP 0 352 591 A1, applying and removing size is accomplished by first coating the web of fabric with a desizing solution, which, after a certain dwell time, is removed together with the size, for example, by washing. The desizing solution is applied to the fabric either by a plurality of aerosol-type spray nozzles or by hot steam. In the simplest case, the desizing agent is mere water which soaks and swells the size and, ultimately, separates the size from the yarn. If appropriate, the water may contain suitable additives.

After washing, the remaining wash solution has a relatively small size concentration, which must be disposed of in some manner. The cost of disposing of the remaining wash solution has been rising because of, for example, ever increasing local environmental protection laws, rules and regulations. While it is possible to recover size from the solution using ultrafiltration (to a concentration of between 2% and 15%), that process is very expensive.

Accordingly, it is an object of the present invention to provide a more economical way to produce webs of fabric.

SUMMARY OF THE INVENTION

This and other objects are achieved according to the present invention by adding to the desizing solution, before it is applied to the web of fabric, a desizing agent that contains size that has been removed from the web of fabric in a downstream liquid removal station.

Adding size to a solution that is to be used to remove size from a web of fabric appears, at first, to be counter intuitive. Therefore, a brief description of the background of sizing may provide a better understanding of this concept. The size is first mixed with a liquid, typically water, hereinafter referred to as a "size carrier" before it is applied to the web of fabric. The size carrier preferably has a size concentration in the range between 2% and 15%. The size concentration is a factor in determining the viscosity of the size carrier. At concentrations up to 3%, the solution has a viscosity that is similar to that of water. At concentrations from 5% to 12%, the solution has a viscosity that resembles that of mucilaginous paste. At concentrations above 15%, for all practical purposes, the solution becomes so viscous that it becomes unprocessable. After the production process (e.g., weaving), the size must be removed again, which has been conventionally achieved by washing, for example, with water.

The wash water, thus, contains size, but not enough to permit reuse of the wash water as the size carrier. As mentioned above, the relatively expensive process of ultrafiltration has been used to recover size from the wash water.

An advantage offered by the method according to the present invention is that the exposure of the fabric to the size is increased so that, when the size containing desizing solution is removed, that wash water solution contains a higher size concentration. In other words, the resulting wash water contains a size concentration that is only minimally, rather than substantially, below the desired size concentration of the size carrier. If the size concentration in the wash water solution needs to be increased further, such upgrading can now be obtained more inexpensively, resulting in overall cost savings in the production of the web of fabric. The addition of a size containing desizing solution to the size carrier before the applying step permits for fairly easy removal of the size and, thus, permits for a smooth transition to another treating step, such as, for example, bleaching.

Another advantage of the present invention is the ability to proceed with a second treating step immediately after the first treating step so that the overall processing cycle can be shortened. In accordance with the present invention, it is no longer necessary, as in the past, to first apply the desizing agent to the fabric and then have to wait for an extended period of time for the agent to take effect (e.g., soak), which is typically between four and twenty-four hours. These conventional methods, therefore, require an interruption of the process cycle, resulting in the fact that the web of fabric has to be rolled and unrolled several times.

The method according to the present invention permits processing in one continuous operation. In other words, the fabric can pass through the desizing station and upon exiting the desizing station can immediately enter into a second treatment station.

In accordance with the present invention, the amount of desizing solution applied to the web of fabric is preferably maintained at a sufficiently small level to prevent the solution from dripping off the fabric. The smaller the amount of solution, the higher the relative concentration of the size constituent in the size/desize solution combination that is subsequently removed. Since the desizing solution applied already contains size, it will be possible in the subsequent removal of the desizing agent to obtain high enough concentrations so that the recovered desizing solution (e.g., wash water) can be reused for sizing as the size carrier in an essentially unmodified form. Also, the size content in the applied size carrier makes the solution somewhat viscous, thereby improving its adhesion to, and corresponding effect on, the fabric.

The size containing size carrier is preferably initially removed from the fabric by a mechanical device and the fabric is, thereafter, rinsed in a wash stage with only a small amount of water. Initially removing the size containing size carrier by mechanical means ensures that wash water solution will not be diluted because relatively little water is required to rinse the web of fabric of any remaining size. The size carrier removed by the mechanical device has a relatively large size component.

The mechanical device is preferably a suction device to vacuum the size carrier off of the fabric. Alternatively, the size carrier may be squeezed out of the fabric by a squeeze device. Both of these mechanical methods permit substantial removal of the size containing size carrier from the fabric.

After the wash, the wash water contains a size concentration in the range of between 2 and 4%. While relatively little water is used, the amount used is sufficient to remove the size from the fabric. Any small amount of residual size that may remain in the fabric is removed in a downstream second wash stage so that there will only be negligible amounts of residual size in the fabric, which will not have an effect on the subsequent treating step.

After the wash, the size containing wash water is preferably fed directly to the application spray nozzles. Little or no "fresh" water needs to be added to the recycled wash water. Thus, the wash water, which already contains a certain amount of the desired size, is used to apply size to the web of fabric. The size containing wash water can be fed to the application spray nozzles together with the size containing size carrier that is mechanically removed from the fabric. There are, of course, limitations, such as, for example, too large of a size concentration in the desizer solution can negatively affect its application properties.

The size-to-solution ratio in the size containing size carrier is preferably at a predetermined ratio so that the liquid that is mechanically removed from the web of fabric has a size carrier component in the range of between 60% and 80% of the desired size concentration. When a web of material with a certain size concentration is treated with a size containing size carrier which itself contains an elevated size concentration, the two will combine into a concentration that is higher than the original concentration. If, relative to the weight of the web of fabric, the amount of applied size carrier is held at a very low level (e.g., 50% to 80%), a downstream solution removal device will have wash water that has a size concentration (e.g., 5% to 10%) which far exceeds the concentrations attainable to date by conventional methods (e.g., 1% to 3%). The wash water removed by the downstream solution removal device has a size concentration that is relatively close to the concentration range needed in the size applying operation. Therefore, by suitably varying the amount of wash water, the size concentration wash water can be modified as desired.

The time span between the application of the size carrier and its removal should preferably be 120 seconds or less. This period of time is long enough for the size carrier to be effective. In a particularly effective mode of application, a time span of 40 seconds or less will suffice.

These brief treatment times are possible especially when the web of fabric is kept in a vapor atmosphere from the time of the application of the size carrier to its mechanical removal. The vapor atmosphere (i.e., steam) exposes the fabric to an elevated temperature and increased moisture levels. An elevated temperature allows the desizer to be more effective, for example, by allowing for a faster soaking action of the water on the size. Elevated temperatures also enhance the effectiveness of applying the size by aerosol or steam since the fabric does not need to be heated up by the desizer.

The size containing size carrier that is mechanically removed from the fabric is preferably reprocessed for reuse of the size, thereby permitting for the size to be recycled. In many cases, it will no longer be necessary to dispose of the size.

In accordance with a presently preferred embodiment of the present invention, an apparatus for continuously treating a web of fabric includes a first treating station and a second treating station. The first treating station is a desizing station that is equipped, in succession, with an application nozzle spray stage, a dwell stage, a mechanical liquid removal device and a wash stage. A first return conduit leads from the wash stage back to the nozzle spray stage. The desizer removed from the fabric in the wash stage is reapplied on the fabric via the spray nozzles. In the dwell stage, the size carrier acts on the size so that, together with the size already on the web of fabric, it can be removed by the mechanical liquid removal device. Thus, the removed liquid has a relatively high size content. The apparatus removes size from the web of fabric by first applying size to the web so that the size concentration of the removed wash water will be higher than in a conventional apparatus.

The spray nozzles are preferably binary nozzles (i. e., two-component nozzles). Binary nozzles permit the application of a size carrier in the form of an aerosol or steam even when the size carrier contains a higher size concentration (i.e., is more viscous).

The mechanical liquid removal device is preferably a suction device. A suction device permits size containing size carrier to be removed from a web of fabric without any water being added, which would result in dilution of the size concentration of the removed liquid.

Alternatively, the mechanical liquid removing device can be a wringer or squeezer. A wringer or squeezer will also remove liquid from the fabric without diluting the size concentration.

The liquid removal device is preferably connected to the application stage by way of a return conduit. It is, therefore, possible to return both size and size carrier to the application spray nozzles from the mechanical liquid removing device, thereby permitting a relatively high size content in the reapplied size carrier. The application of size to the fabric during the desizing process can be augmented to a point where the size containing size carrier is in the range between 2% and 5%, which essentially corresponds to a 40% and 80% size carrier component in the removed liquid.

A second return conduit from the mechanical liquid removal device directs the removed liquid into an external size reservoir. Only a portion of this removed liquid (e.g., less than 50%) is fed to the application nozzles. A solution can be collected in the size reservoir which, by removing a small amount of water, can be used as the size carrier.

A steaming section is preferably disposed upstream from the application stage so that the web of fabric can be presteamed, thereby raising its temperature before the size carrier is applied on the web of fabric.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PREFERRED EMBODIMENT

Figure 1A:
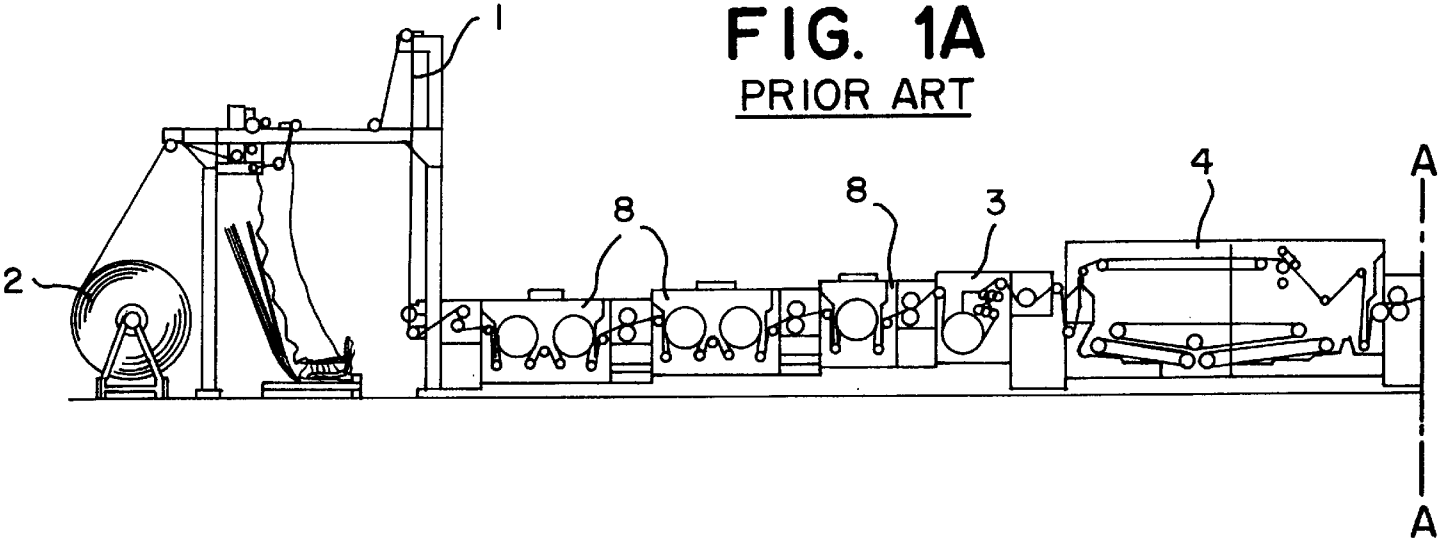
FIG. 1A PRIOR ART
FIGS. 1A and 1B are a side view of a prior art apparatus.
Figure 1B:
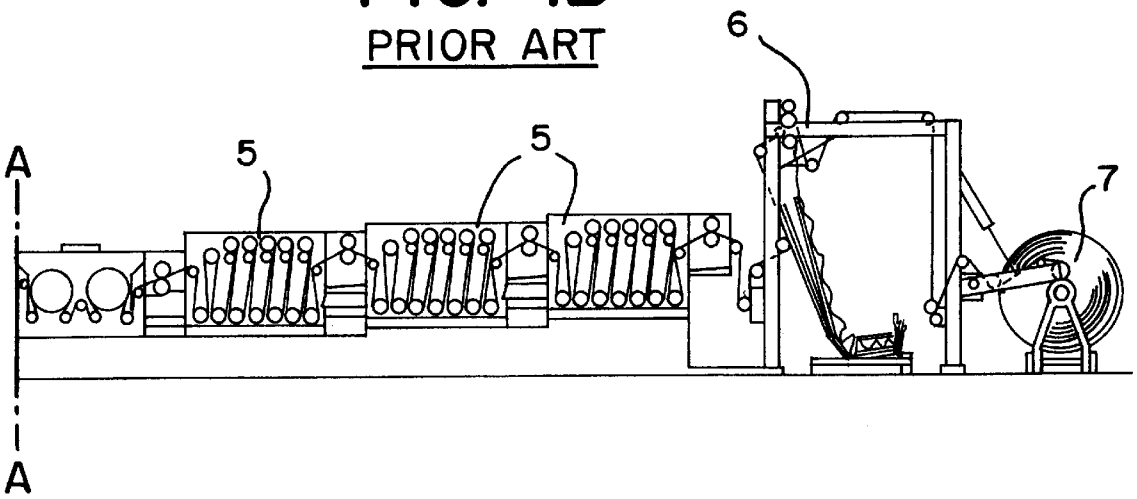
FIG. 1B PRIOR ART

Referring now to FIG. 1, a prior art apparatus for treating a web of fabric 1 that is unwound off a dry roll 2 is illustrated. Web 1 is prewashed in wash stages 8 and is then fed to a solution application device 3. Web 1 is then fed to a steam section 4 where the fabric 1 is subjected to a vapor atmosphere. A rinsing device 5 is disposed downstream from the steam station, which is followed by a winding station 6 where the web of fabric 1 is rewound onto a roll 7.

This conventional apparatus may, under appropriate conditions, treat the material in one operation. In other words, the web of fabric 1, which constitutes raw material wound on roll 2, is converted into a finished product in one single pass and is then wound onto roll 7. However, processing a web in one single pass has a variety of associated problems, especially in the desizing process. For example, the amount of size remaining on the web of fabric, before a second treatment stage, such as, for example, bleaching, are often at levels that are higher than desired. Residual size on the web of fabric will react with the chemicals of subsequent processes, thereby creating significant problems. This is especially true in cases where the size applied on the web was not sufficiently soaked.

To assure satisfactory processing of webs of fabric, it is conventional to saturate the fabric with an excessive amount of a desizing agent (e.g., water or an oxidative solution). The desizing agent is then squeezed out of the web, and is followed by several hours (e.g., between 2 and 24 hours) of interim storage to allow the size carrier to work. The fabric is not ready for further processing until this rather time consuming process has taken place. Any further processing must begin with a complete wash and rinse operation in several wash stages 8. One clear drawback of this conventional method is its discontinuity (i.e., the interruption of the treatment) and the very low concentration of the separated size in the wash water because of the relatively large amounts of water that are used.

The wash water is processed in a size recovery station using ultrafiltration. In other words, the diluted wash water is re-processed to permit recycling of this fluid, which is an operation that takes place away from and extraneous to the fabric finishing process.

Figure 2A:
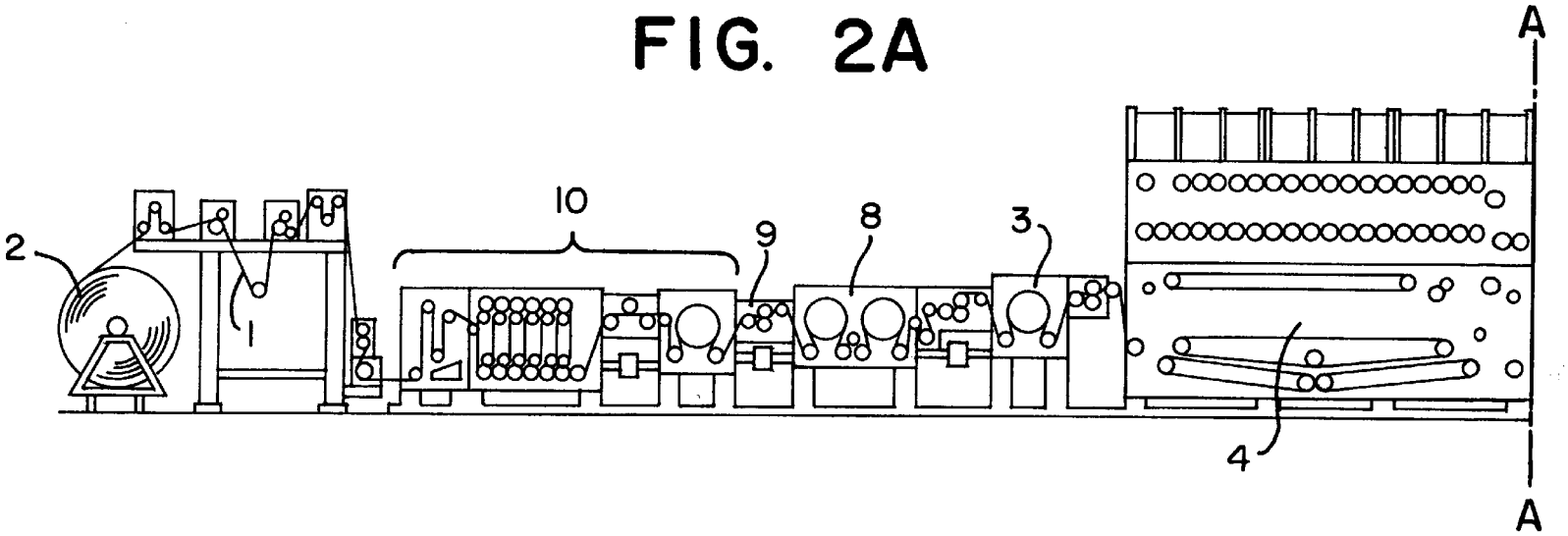
FIGS. 2A and 2B show a side view of an apparatus incorporating a desizing station according to the present invention.
Figure 2B:
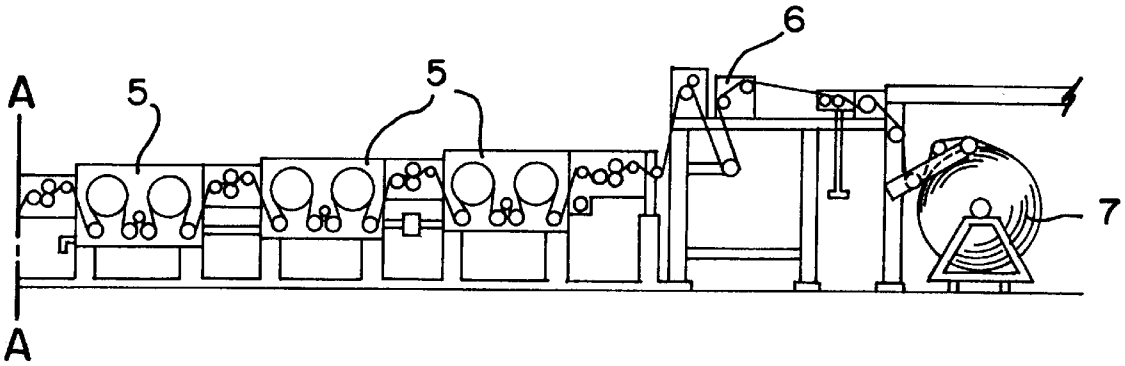

In accordance with the present invention, one or more wash stages 8 from the conventional system are replaced with one desizing section 10 as shown in FIG. 2. The remaining configuration of the system as illustrated in FIG. 2 is identical to that shown in FIG. 1, and, therefore, like reference numerals are hereinafter used to refer to like elements.

Figure 3:
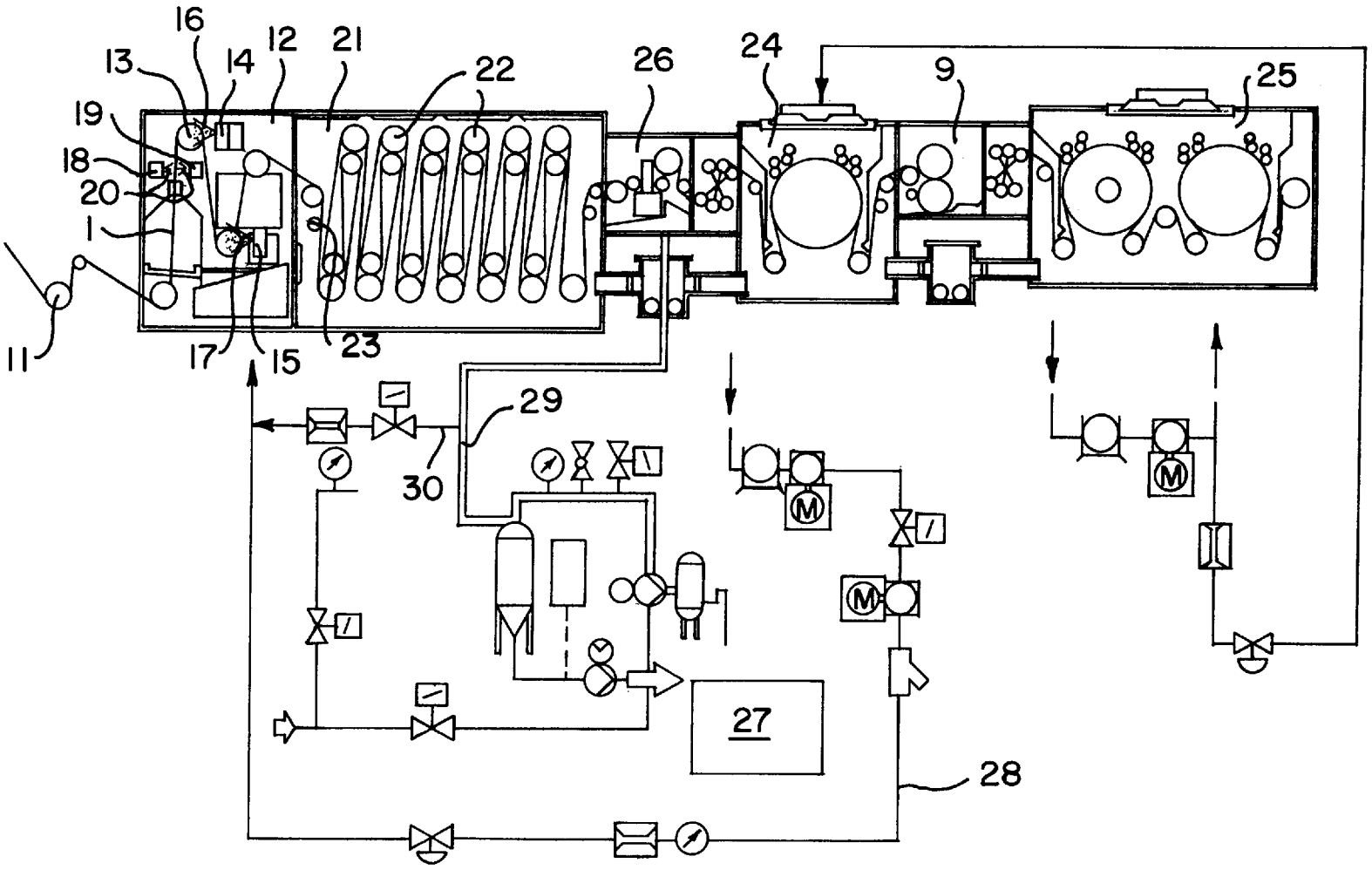
FIG. 3 is a side view of the desizing station illustrated in FIGS. 2A and 2B.

Referring now to FIG. 3, a more detailed view of the desizing section 10 is illustrated. The web of fabric 1 passes through an intake roller assembly 11 before entering the application stage 12. In the application stage 12, web 1 passes by application nozzles 14, 15. Web 1 is guided through stage 12 by rollers 13 in such a way that both sides of the fabric 1 are sprayed with size carrier by the application nozzles 14, 15. In the non-limiting, illustrated, exemplary embodiment, the application nozzles are binary mixing nozzles that have external mixing capability. Nozzles 14, 15 are supplied with both size carrier and steam. The size carrier can be, for example, water, which, according to the present invention, already contains size. The binary mixing nozzles are, thus, capable of spraying an aerosol 16, 17 onto the fabric 1 at an elevated temperature and at a relatively high pressure. The elevated temperature is around 100° C. or can be even higher if the steam that is fed to the spray nozzles 14, 15 is placed under appropriately higher pressure. The steam will condense on the web 1, thereby raising the temperature of the web 1. At the same time, the steam, and with it the finely dispersed droplets of size containing size carrier, penetrates into the web of fabric 1.

To enhance these application conditions even further, upstream from the first size carrier application (i.e., upstream of the first spray nozzle 16 in the travel direction of the web of fabric 1), a set of steam jet nozzles 18, 19 can direct a jet of steam 20 at the web of fabric 1. Thus, nozzles 18, 19 together constitute a steaming station. Concurrently, steam jets 18, 19 can fill the interior of the application stage 12 with vapor, so that the web of fabric 1 is not only heated by the time the size carrier is applied by nozzles 14, 15, but can, in fact, remain at the steam temperature during the entire passage through stage 12.

A dwell-stage compartment 21 is disposed downstream from the application stage 12. The web of fabric 1 is guided through dwell stage compartment 21 by several guide rollers 22. Dwell stage 21 is filled with steam from stage 12 through a plurality of intake openings 23 (only one of which is shown in FIG. 3). In the dwell compartment, the size carrier has ample time and optimal environmental conditions to work on the fabric and to adequately soak into the fabric to remove the size. The steam that is fed into dwell stage 21 is at a sufficient temperature to maintain the temperature of the web 1 at the necessary level to ensure that the size carrier has essentially removed the size from the web 1. Spray nozzles 14, 15 apply only enough size carrier to the web of fabric 1 so that it is moist, but not wet. In other words, the application of the liquid by nozzles 14, 15 is limited to a predetermined amount so that none of the liquid drips off of the web of fabric 1. This condition can easily be met by using only a slightly larger amount of liquid than if pure water were being applied because the applied size carrier contains size, which makes the size carrier more viscous than pure water. Because a more viscous liquid will adhere better to the web of fabric 1, using only a slightly larger amount of liquid than would be required if pure water were applied ensures that essentially all of the applied viscous liquid will adhere to the fabric.

A mechanical liquid removal device 26 is disposed immediately downstream of dwell stage 21. Mechanical liquid removal device 26 removes liquid (i.e., the size carrier with the separated size and the size that was previously contained in the size carrier) from the fabric 1. The liquid removal device 26 may, for example, be a pair of wringers or squeeze rollers or a suction device. The web of fabric 1, upon exiting from dwell stage 21, will have a coat of size carrier and size on it, which has a consistency somewhat similar to honey. Together with the soaked, swelled size, the size carrier is essentially peeled off of the web of fabric 1 by mechanical liquid removal device 26.

A wash stage 24 is disposed immediately downstream of the mechanical liquid removal device 26. Any residual size that was not removed by the liquid removal device 26 is washed off of the web of fabric 1 with very little water. The wash water (i.e., the water removed from wash stage 24) contains a distinctly measurable size concentration of about 2% to 4% because so little water is used by wash stage 24.

Depending on the desired residual size content on the web of fabric 1, wash stage 24 can be followed by a second wash stage 25. In second wash stage 25 an adequate amount of fresh water will almost entirely remove any residual size.

In a continuous in-line operation, the web of fabric 1 would next travel to a second solution application station 3 (see FIG. 2). Reactive chemicals, such as, for example, bleach with peroxide-based substances, are applied to the web of fabric 1 in a conventional manner in the second solution application station 3. The applied reactive chemicals are then permitted to react in a conventional, downstream steam section 4. Thereafter, the web of fabric 1 passes through a wash station 5 that has a plurality of wash stages. The web of fabric is then stacked or wound to form a roll 7.

Referring once again to FIG. 3, after the web of fabric 1 has passed through wash stage 24, the water can be removed from the web 1 by using a liquid removal system 9. The web of fabric can then be spooled for interim storage before any further processing. If there is a major time interval between the desizing of the web and any further processing, it is desirable to dry the web 1 by thermal means. In many cases, however, the desized web of fabric 1 is fed directly to the input of a second treating apparatus so that the web can be finished at the earliest possible time.

A first return conduit 28 leads from the wash station 24 to the application stage 12 to recycle the size containing wash water. The fact that the wash water already contains some size is, generally, not a problem because if more size is applied to the web of fabric 1, the size concentration in the liquid that is removed from the fabric 1 by the mechanical liquid removal device 26 will be correspondingly higher.

A conduit 29 leads from the mechanical liquid removal device 26 to an external reservoir 27. A second return conduit 30 branches off from conduit 29 and leads to the application stage 12 so that a portion of the liquid removed by device 26, which has a relatively high size content, is reused for application on the next portion of fabric 1 entering application stage 12.

With the aid of second return conduit 30, the liquid size carrier that is applied on the web of fabric 1 by means of the spray nozzles 14, 15 has a relatively high concentration of size. The ratio between the size and the liquid flowing in the first return conduit 28 is preferably between 40% and 80%. The solution flowing through conduit 28 is a combination of the size on the fabric (that was removed by device 26), the size contained in the size carrier before being applied to the web 1 and the size contained in the liquid removed by wash stage 24. For example, if one were to assume that there is one part of size on the web of fabric 1 while the size carrier solution contains one part size and two parts water, the application of the size carrier solution will result in two parts water and two parts size on the fabric 1, so that after the squeezing process by device 26, the size content (i.e., the ratio of size to liquid) will be 50%. Correspondingly, a 50% size content solution can be fed to the reservoir 27, meaning that the size carrier flowing to nozzles 14, 15 from conduits 28, 30 can be reused in application stage 12 in an essentially unchanged form.

A non-limiting example of an initial size carrier solution is outlined below:

| Starting Size Carrier Solution (prepared in the sizing section) | |
|---|---|
| Water | 400 l |
| PVA | 20 kg |
| CMC | 25 kg |
| Adjuvant | 3 kg |
| Condensate | 901 (water) |
| Total | 538 l |
| Size | 8.36% |

If this mixture were to be retrieved in the sizing section it would constitute a recovery rate of 100%. The concentration would then be 8.36% again, and no further size would need to be added to the solution, which, of course, for all practical purposes, is an impossibility.

Recovered Mixture

EXAMPLE #1

The recovered size solution in first return conduit 28 contains a size concentration of approximately 7%. Five (5) to six (6) liters of this solution is preferably drawn off per minute. Of course, the amount of solution drawn off is a function of the amount of size carrier solution that is applied. Thus, about 406 g of size is retrieved per minute or per 5.8 liters. 538 liters of the recovered solution already contains approximately 37.66 kg of size (PVA/CMC=406/5.8×538). This correspond to a recovery rate of about 80% (i. e., the recovered solution corresponds to a size carrier in which the size concentration equals 0.8 times the desired size concentration with reference to starting size carrier solution). Thus, only 7.34 kg of size per minute needs to be added so that the solution will have the level of the starting solution.

EXAMPLE #2

Machine speed=30 m/min

Weight of web material=400 g/m

Size level per m of width=8.36%/2=approx. 4% (only warp is sized)

Production per minute per=30×400=12 Kg of material (warp and weft)/min.

meter of width and m

Size per m of width=480 g/min (i.e., every minute 480 g of size enters the system)

Retrieved at removal outlet (entrance to conduit 28)=7%, 5.8 l/min=406 g/min (70 g/l×5.81)

480 h/min=100%

406 g/min=approximately 80%

What is claimed is:

1. A method for continuously treating a web of fabric in at least a first treatment section and a second treatment section through which the web of fabric passes, the method comprising the steps of:

applying a size containing size carrier solution on the web of fabric to desize the web of fabric;

removing the size containing size carrier from the web of fabric after the size carrier has taken effect upon the web of fabric; and adding at least a portion of the removed size containing size carrier to the size carrier solution before the solution is applied in the applying step to an upstream portion of the web of fabric.

2. The method according to claim 1, wherein the amount of size carrier applied in the applying step is limited so that essentially none of the liquid drips off from the web of fabric.

3. The method according to claim 1, wherein the size containing size carrier is first removed from the web of fabric by a mechanical device and thereafter the web of fabric is washed with a minimum amount of water.

4. The method according to claim 3, wherein the mechanical device removes the size containing size carrier from the web of the fabric by suction.

5. The method according to claim 3, wherein the mechanical device removes the size containing size carrier from the web of fabric by squeezing the agent out of the fabric.

6. The method according to claim 3, wherein, after washing, the size containing wash water contains a size concentration in the range from 2% to 4%.

7. The method according to claim 6, wherein, after washing, the size containing wash water is fed to a plurality of spray nozzles to effect the applying step.

8. The method according to claim 1, wherein the size to solution ratio in the size containing size carrier that is applied in the applying step is predetermined so that the removed size carrier has a size component in the range of between 60% and 80% of the desired size concentration.

9. The method according to claim 1, wherein the elapsed time between the applying step and the removing step is 120 seconds or less.

10. The method according to claim 9, wherein the elapsed time is 40 seconds or less.

11. The method according to claim 1, wherein the web of fabric is maintained in a steam atmosphere between the applying step and the removing step.

12. The method according to claim 1, further comprising the step of treating the size containing size carrier removed during the removal step so that it may be recycled.

13. The method according to claim 1, wherein the web of fabric is bleached in the second treatment section.

14. The method according to claim 1, wherein, before the applying step, the web of fabric is treated with steam.

15. The method according to claim 1, wherein said applying step is effected by high temperature aerosol spraying.

16. The method according to claim 1, wherein said applying step is effected by high temperature steaming.

17. An apparatus for continuously treating a web of fabric, said apparatus comprising:

a first treatment section including a desizing station, said desizing station comprising an application stage having a plurality of spray nozzles, a dwell stage, a mechanical liquid removal device and a wash stage, a first return conduit fluidly connecting said wash stage to said application stage for returning size containing size carrier to said application stage; and a second treatment section disposed downstream, with respect to a direction of movement of said web of fabric through said apparatus, from said first treatment section.

18. The apparatus according to claim 17, wherein said plurality of spray nozzles are two-component nozzles.

19. The apparatus according to claim 17, wherein said mechanical liquid removal device is a suction device.

20. The apparatus according to claim 17, wherein said mechanical liquid removal device is a squeezing device.

21. The apparatus according to claim 17, further comprising a second return conduit fluidly connecting said liquid removal device to said application stage.

22. The apparatus according to claim 17, further comprising a size reservoir being fluidly connected to said second return conduit via a branch line.

23. The apparatus according to claim 17, further comprising a presteaming stage disposed in said first treatment section upstream of said application stage with respect to movement of said web of fabric through said first treatment section.

* * * * *